United States Patent [19]

Huydts

[11] 4,123,929

[45] Nov. 7, 1978

[54] HYDRAULIC PRESS

[75] Inventor: Eduard J. C. Huydts, Düsseldorf-Gerresheim, Germany

[73] Assignee: G. Siempelkamp GmbH & Co., Krefeld, Germany

[21] Appl. No.: 803,314

[22] Filed: Jun. 3, 1977

[30] Foreign Application Priority Data

Jun. 5, 1976 [DE] Fed. Rep. of Germany ..... 2625482

[51] Int. Cl.[2] ..... B21D 7/06

[52] U.S. Cl. ..... 72/453.08; 72/455

[58] Field of Search ..... 72/455, 453.09, 453.08, 72/453.18, 456; 100/214

[56] References Cited

U.S. PATENT DOCUMENTS

| | | | |
|---|---|---|---|
| 2,416,058 | 2/1947 | Mangnall | 100/214 |
| 2,863,343 | 12/1958 | Steinfoft | 72/453.18 |
| 3,316,749 | 5/1967 | Beard | 100/214 |
| 3,668,920 | 6/1972 | Grankowski | 72/455 |
| 3,757,680 | 9/1973 | Williams | 100/214 |
| 3,780,560 | 12/1973 | Zimmer | 72/456 |
| 3,852,991 | 12/1974 | Poggio | 100/214 |

FOREIGN PATENT DOCUMENTS

| | | | |
|---|---|---|---|
| 1,509,128 | 12/1967 | France | 100/214 |

*Primary Examiner*—C.W. Lanham
*Assistant Examiner*—Gene P. Crosby
*Attorney, Agent, or Firm*—Karl F. Ross

[57] ABSTRACT

A hydraulic press, especially a sheet-bending press which has a lower beam provided with a press table and a vertically displaceable upper beam having a plunger or ram. The two beams are connected by columns which are formed as piston-and-cylinder arrangements to the upper and lower beams, respectively, by compensating bearings which permit an inclined orientation of the upper beam relative to a normal horizontal position without interfering with the force-transmitting characteristics. The compensating bearings are constituted as transverse bearings having bearing axes which are perpendicular to the longitudinal dimension of the beam and through which the piston-cylinder arrangement is pivotally connected to the upper and lower beams.

12 Claims, 7 Drawing Figures

HYDRAULIC PRESS

FIELD OF THE INVENTION

The present invention relates to a hydraulic press, especially a sheet-bending press, having upper and lower beams which are displaceable relative to one another by hydraulic means and which permits a tilting orientation of the upper beam during the pressing process.

More particularly, the invention relates to improvements in the connection of a piston-and-cylinder arrangement to a press beam.

BACKGROUND OF THE INVENTION

Hydraulic presses for the stamping of domed metal sheets, e.g. in the formation of automotive-vehicle body parts, are known in which an upper beam is movable by a piston-and-cylinder arrangement relative to a lower beam to which the piston-and-cylinder arrangement, hereinafter hydraulic cylinder, is connected. The piston rods of the hydraulic cylinders constitute the columns of the press.

In this conventional construction, the piston rods carry an upper beam which is releasably mounted upon these rods by means of anchoring nuts. In order to permit the columns to take up the bending moment imparted to the upper beam during the pressing process, the cylinders which receive the piston rods are generally mounted on the lower beam and between these cylinders and the piston rods, a pivotal connection is provided. At their upper ends, the piston rods are provided with axial-elastic annular compression sleeves engaged by anchor nuts to provide a somewhat pivotal connection between the piston rods and the upper beam. Each of the axial-elastic pressure sleeves is formed as a profiled sleeve and is centered in an annular recess filled with elastic material in a support ring bearing upon the upper beam. The piston rod has a threaded end which passes through the profiled sleeve and the pressure-transmitting ring and threadedly receives the anchor nut.

The pivotal connection of the piston rod in the cylinder is effected usually by a floating disk which bears against a nut threaded onto the cylinder whereby the inner surface of the disk and the portions of the piston engaging the cylinder wall have rounded configurations.

As a consequence of this construction, in this conventional press the pivot permitting canting of the upper beam is excessively complex since either the axial-elastic pressure sleeve or the floating disk may be readily damaged upon the development of extremely high pressing forces and relatively large bending moments (cf. German patent DT-PS 1,962,811).

OBJECTS OF THE INVENTION

The present invention has as its principal object the provision of a hydraulic press, especially a metal-sheet bending press, which is relatively simple, functionally more reliable and more robust than prior-art presses, particularly with respect to the pivotal connection between the upper and/or lower beams and the piston-and-cylinder arrangement.

Another object of the invention is to provide a hydraulic press of the character described whereby the pivotal connection between the press columns and the upper and/or lower beams is not subjected to any significant bending moment during the press process.

It is also an object of the invention to provide an improved articulation between a press column and a respective press beam.

SUMMARY OF THE INVENTION

These objects and others which will become apparent hereinafter are attained, in accordance with the invention, by providing the compensating bearings between the press column and the respective beam as a transverse bearing with a pivot axis extending transversely (perpendicularly) to the longitudinal dimension of the beam. Thus the upper and lower beams may be articulated to each of the columns of the press, whereby the column is formed by a piston-and-cylinder arrangement, by a so-called transverse bearing with a pivot axis perpendicular to the axis of the cylinder arrangement and perpendicular to the longitudinal dimension of the beam. The transverse bearing can consist essentially of a bearing pin connected to one of the members, i.e., the beam or the column, and a bearing shell connected to the other of these members. The transverse bearing functions as a slide bearing and little wear, long life and effective force transmission, since the pressing forces are always provided in the radial direction between the bearing shell and the bearing pin.

Most surprisingly, I have found that the use of a transverse bearing both at the upper and lower ends of the column between the upper and lower beams permits an inclination of the upper beam during the pressing process and/or various thermal expansion and contraction movements between the upper and lower beams so that the columns may cant to a certain extent while maintaining the columns completely free of bending moments, i.e., moments transverse to the longitudinal axis of the columns. A "column" in this sense may consist of the cylinder of the piston-and-cylinder arrangement which can be connected to one of the beams and the piston and piston rod which can be connected to the other of the beams.

The transverse bearing of the present invention always has its axis orthogonal to the longitudinal dimension of the beam. When the beam is formed with a plurality of arms, e.g. in cruciform configuration, T-configuration or the like, the longitudinal direction is always the longitudinal dimension of the arm to which the transverse bearing is connected. Thus, in the case of a three-arm T-configuration beam provided with three columns, each at the end of one of the arms, the transverse bearing between each column and the respective end of the arm will have its axis perpendicular to the longitudinal dimension of this arm.

Put otherwise, the transverse bearing axis always runs substantially parallel to the diagonal of a press having cruciform upper and lower beams or head and bed plates.

According to a feature of the invention, all fluid-medium connections for operating the press can be provided in the lower portion of the latter so that when the press is operated with oil, no combustible-liquid containers or ducts are provided above the workpieces which can be pressed in the hot state.

For taking up eccentric loads during the coarse of the pressing process, the press according to the present invention can be provided with parallel controls so that the eccentric loading can be compensated by different pressures applied to the cylinders of the columns and hence the guides can be maintained free from the need to take up such eccentric loads. This parallel control can be provided in that each cylinder is provided with a position indicator which permits only one of the cylinders acting on the upper beam to function as a master and causes the remaining cylinders to follow. When four columns are provided, two cylinders acting on the same side of the beam can be connected to a common pressure line and the two remaining cylinders can be actuated in response to the position measurement parallel to the diagonally opposite cylinder. The press according to the invention can be used for both hot and cold pressing, for drawing, for stamp-bending, bending, embossment and forging operations and other operations common in the hydraulic-press art.

According to still another feature of the invention, the transverse bearing received in the upper beam can be provided with two bearing halves formed by the bearing pin which can have a throughgoing bore through which the piston rod of the respective column extends with anchor nuts threaded onto this piston rod above and below the bearing pin to permit vertical adjustment thereof along the piston rod. This construction afforts an especially simple pivotal connection of the cylinder arrangement to the upper beam.

The lower bearing half comprises a shell half provided with bearing ribs acting upon the upper beam while the upper bearing half is formed as a bearing shell half engaged by bearing plates, the bearing plates being bolted to the upper beam or the bearing ribs mentioned previously.

In addition, axial positioning of the bearing pin can be accomplished by endplates.

According to a preferred embodiment of the invention, the columns are arranged in side stands and the upper beam is guided in the side stands of the press, the side stands and the upper beams being formed with mutually engaging relatively slidable guide pieces.

The latter construction ensures compensation not only for inclinations of the upper beam but also thermal expansion and contraction thereof. The side stands remain completely free from the pressing forces and need only take up the lateral guide forces.

According to still another feature of the invention, the transverse bearing at the lower beam, which can be used to articulate the vertically fixed cylinder, is constituted as a bifurcated head having bearing recesses on opposite sides and receiving the bearing pin which engages the lower beam. The bifurcated head can be subdivided into upper and lower bearing halves. This transverse bearing of the present invention is also very simple and is capable of taking up extremely high forces. The bifurcated head can, in the region of its upper bearing half, be formed unitarily (i.e., in one piece) with the cylinder, e.g. cast therewith, and can be formed with endplates as carrier for the lower bearing half. In the region of the lower bearing half, the bifurcated head can be connected to endplates. According to the invention, between the two bearing pins in the bifurcated head, a retraction piston is disposed, the retraction cylinder sliding on this retraction piston forming, in turn, the piston of the respective column.

The endplates and bearing plates can be complemented by transverse plates to form a box-like structure which can partially enclose the retraction piston.

Finally, the upper beam can be provided with a hold-down device and the hold-down device, as with the upper beam, can be connected with the lower beam via a cylinder arrangement having a retraction piston forming a column. In this case, the cylinder arrangement for the hold-down decive is connected to the latter and to the lower beam by transverse bearings of the type described previously. Between the upper beam and the hold-down device there can be provided a coupling, e.g. a plug coupling, whereby the upper beam and the hold-down device are synchronously and simultaneously actuated with the hold-down device having its cylinder arrangement actuated first and the cylinder arrangement of the upper beam actuated subsequently for operation of the ram.

The system of the present invention has numerous advantages. For example, it provides a hydraulic press, especially a sheet-bending press, whose upper beam can undergo canting or tilting movements during the pressing process without applying any bending stress to the columns. During the pressing of hot workpieces the expansion of the lower beam relative to the somewhat cooler upper beam creates relative thermal expansion and contraction movements between the two beams which can be fully compensated within the system of the present invention. The pivotal connections between the columns and the beams are extremely simple and highly reliable with long useful life. Throughout, an automatic centering of the ram relative to the bedplate of the press is ensured.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
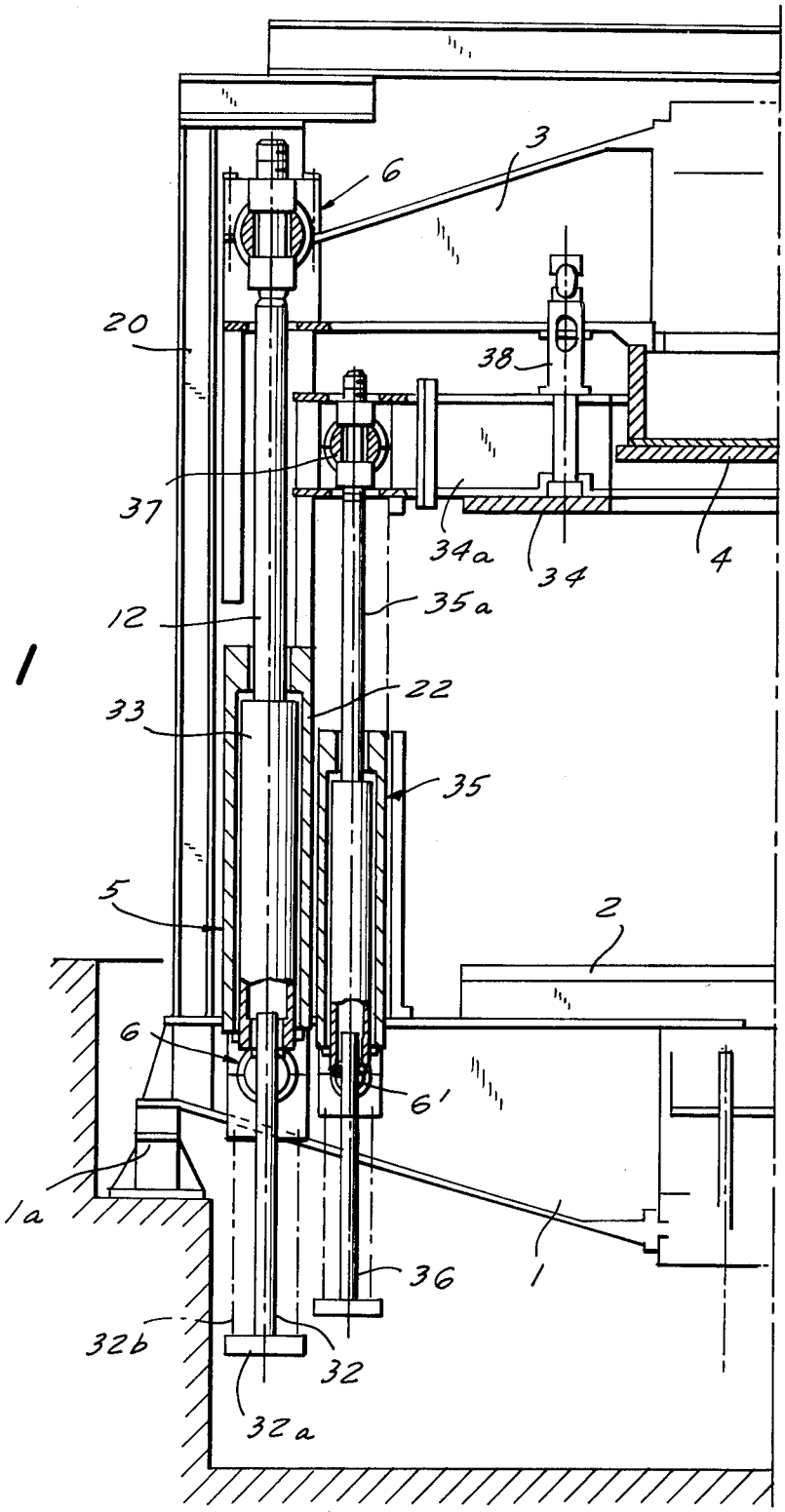
FIG. 1 is a vertical cross-sectional view, in diagrammatic form, illustrating the invention as applied to the opposite arms of an upper and lower beam assembly for a hydraulic press which is of the four-column type with cruciform configuration.
Figure 1A:
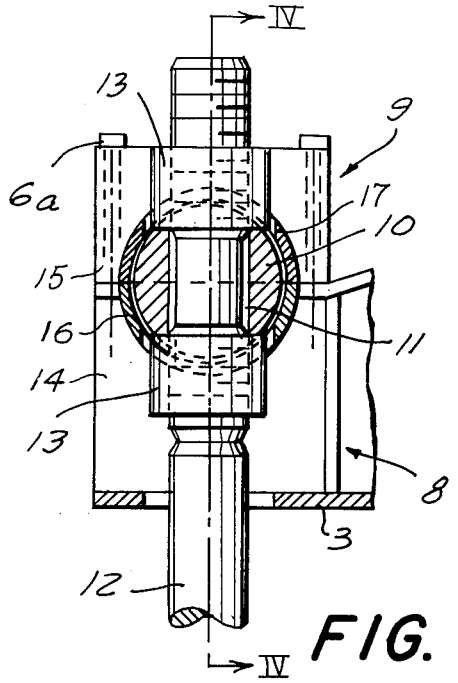
FIG. 1A is a detail view of the upper pivot assembly according to the invention.
Figure 1B:
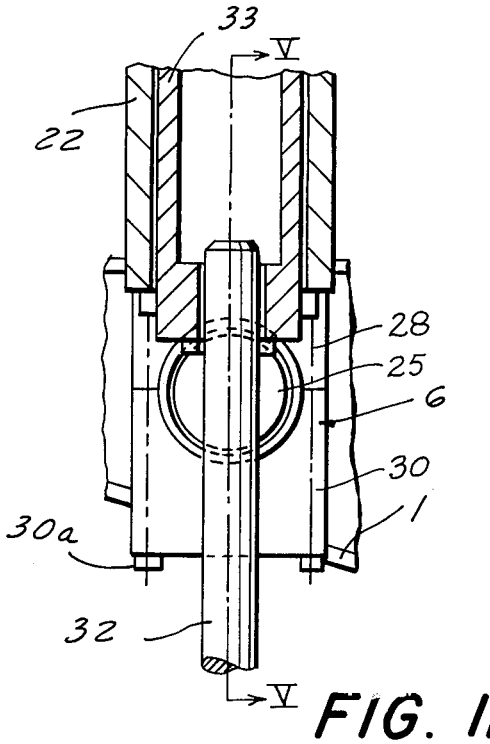
FIG. 1B is a detail view of the lower pivot assembly of the invention.

In the drawing I have shown a hydraulic press, especially a sheet-metal bending press, in an embodiment in which the press has four main columns disposed at the ends of respective arms of a cruciform upper beam and a cruciform lower beam. Of course, the principles of the invention are also applicable to two-column and three-column presses.

In any case, the press comprises, basically, a lower beam 1 formed with a pressing table or bed 2 and an upper beam 3 having a ram or stamp 4. The two beams 1 and 3 are connected by columns which are formed as piston-and-cylinder arrangements and generally represented at 5.

Between each beam and the cylinder arrangement 5 there are disposed transverse bearings 6 having bearing axes 7 which couple the ends of the cylinder arrangement 5 to the upper beam 3 and the lower beam 1.

The upper beam 3 is formed (FIGS. 1, 2 and 4) at the end of each arm provided with a respective transverse bearing 6, with a pair of bearing halves 8, 9 held together by bolts 6*a* which receive a bearing pin 10 having a throughgoing bore 11 (FIG. 4) through which the piston rod 12 of the respective cylinder arrangement 5 passes.

Figure 4:
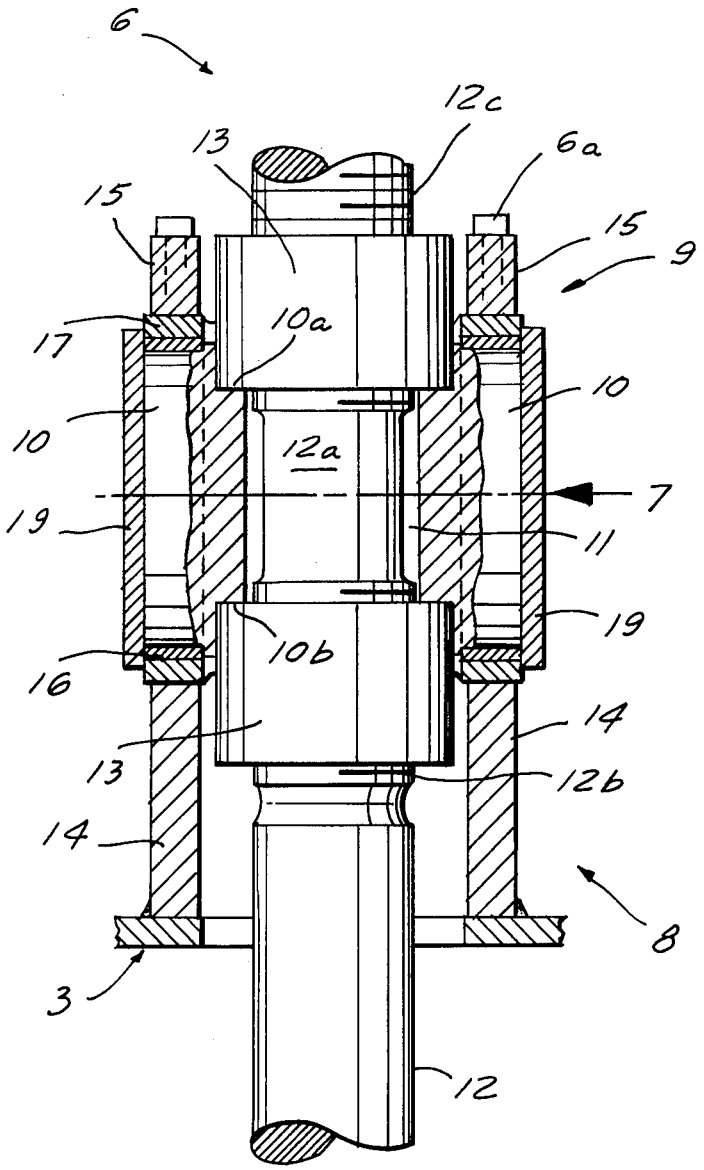
FIG. 4 is a vertical section through the upper pivot (e.g. as taken along line IV—IV of FIG. 1A)
Figure 5:
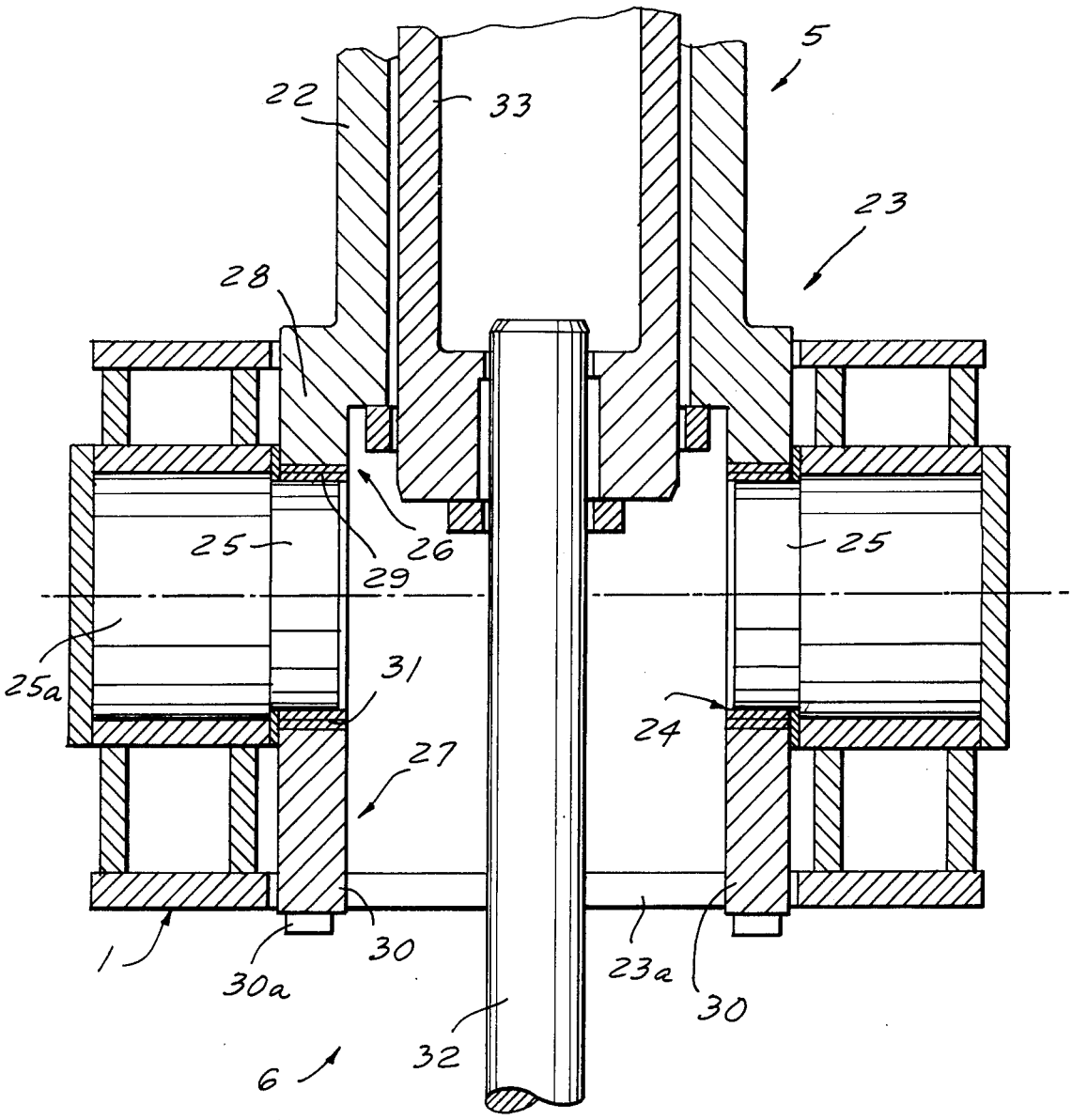
FIG. 5 is a vertical section through the transveerse bearing of the lower pivot (e.g. as taken along line V—V of FIG. 1B).

As is also apparent from FIG. 4, the piston rod 12 has a narrow neck 12*a* separating threaded portions 12*b* and 12*c* from one another, these threaded portions receiving nuts 13 which project in part into counter-sunk recesses 10*a* and 10*b* of the bearing pin 10. By threading the nuts 13*a* and 13 up or downwardly along the piston rod 12, the position of the respective end of the upper beam with respect to the lower beam for a given extension of the piston rod 12 can be assured.

The lower bearing half 8 is formed with an upwardly concave recess and is defined by upstanding ribs 14 welded to the top of the upper beam 3 or forming part thereof. These ribs are best seen in FIG. 4 and have been termed bearing ribs herein.

The upper bearing half 9 is defined by plates 15 which carry the bearing shell halves 16 and 17. These semicircular shell halves are sandwiched between the wall of the recess defined by the bearing halves 8 and 9 and the external surface of the cylindrical pin 10.

Via the bolts 6*a* as previously described, each plate 15 is connected to one of the ribs 14 whereby the bolts 6*a* can flank the pin 10 and extend into bearing ribs 18 connected directly to the beam.

The bearing plates 15 together with the ribs 14 of the beam form support for closed bearing shells 16 and 17.

To prevent movement of the pin 10 along its axis 7, endplates 19 are provided. These endplates can be bolted to the pin and have greater diameters than that of the pin so that they form shoulders engaging the lateral flanks of the members 14 and 15 previously described.

The columns are each received in a side stand 20. The upper beam 3 is guided in the side stand 20 so that it can shift relative thereto in the longitudinal direction of the beam arm. In other words, movements in the direction of the axis 7, i.e., in the direction of arrow A, are prevented while movements in the direction of arrow B are permitted (see FIG. 2).

To this end, the side stand can be formed with a pair of shanks 20*a* and 20*b* connected by a bight 20*c* so as to have a generally U-shaped horizontal profile embracing the end of the upper beam 3 in the region thereof connected by the bearing 6 to the column. The cheeks 3*a* and 3*b* of the beam are provided with antifriction guide plates 21*a* and 21*b*, respectively, sliding on plates 21*c* and 21*d* along the surfaces 20*d* and 20*e* of the shanks 20*a* and 20*b*.

The lower beam 1 at the end of each arm provided with a transverse bearing 6 (see FIGS. 1, 1B, 3 and 5) each rests upon a pedestal 1*a* and carries the stand 20 along which the beam 3 is vertically shiftable and can cant in the manner described previously.

The columns 5 each comprise, in addition to the piston rod 12, a cylinder 22 which is formed with a bifurcated head 23 (FIG. 5) the arms of which form bearing plates as will be described in greater detail below. These arms are provided with cylindrical bores 24 receiving the lower bearing pins 25 having a common axis 25*a* parallel to the axis 7 of the upper transverse bearing 6.

The bifurcated head 23 can either be undivided or can be subdivided in the manner described with respect to the members 14 and 15 discussed previously. A divided construction is preferred as has been illustraed in FIGS. 1B and 5.

In this preferred construction the bifurcated head 23 is subdivided into an upper bearing half 26 and a lower bearing half 27. The upper bearing half 26 is formed in one piece with the cylinder 22, i.e., cast integrally therewith, and is formed with the downwardly concave arms 28 having the configuration of plates perpendiuclar to the axis 25*a*. The plates 30 forming the lower bearing half 27 are bolted at 30*a* to the arms 28.

Each of the lower bearings is formed with a pair of bearing pins 25 which can be fixed to the lower beam 1. These pins 25, having a common axis 25*a*, function as a single pin having a throughgoing opening.

Between the pins 25, within the bifurcated head 23, a retraction piston 32 is disposed, this piston 32 being fixed by means of a bracket 32*a* to the bifurcated head 23.

A cylinder 33, i.e., the retraction cylinder, rides upon piston 32 and forms the piston for the piston rod 12 previously described.

Figure 2:
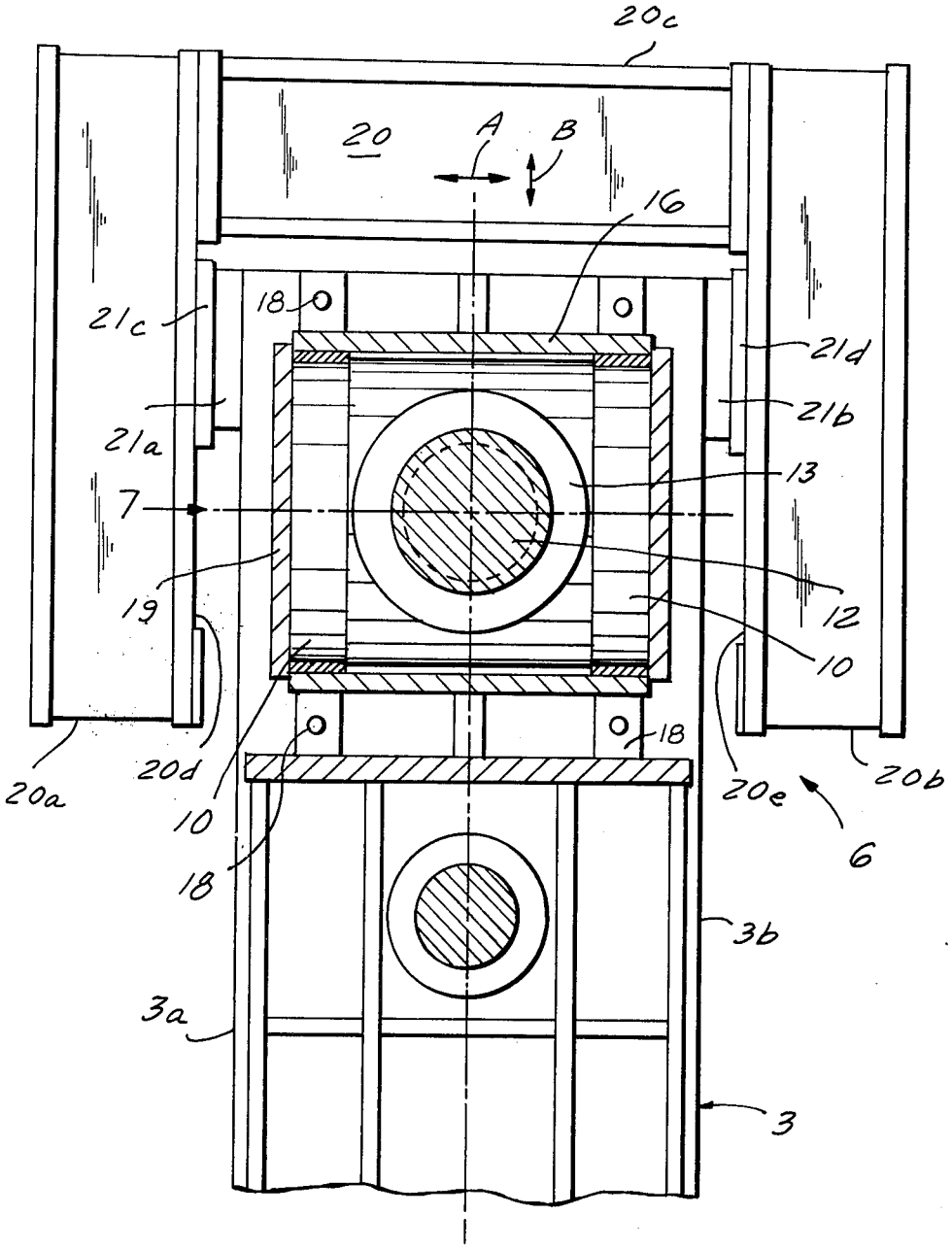
FIG. 2 is a detail plan view drawn to a larger scale than that of FIG. 1A but illustrating the pivot assembly thereof in cross-section in a plane perpendicular to the sectional plane of FIG. 1A.
Figure 3:
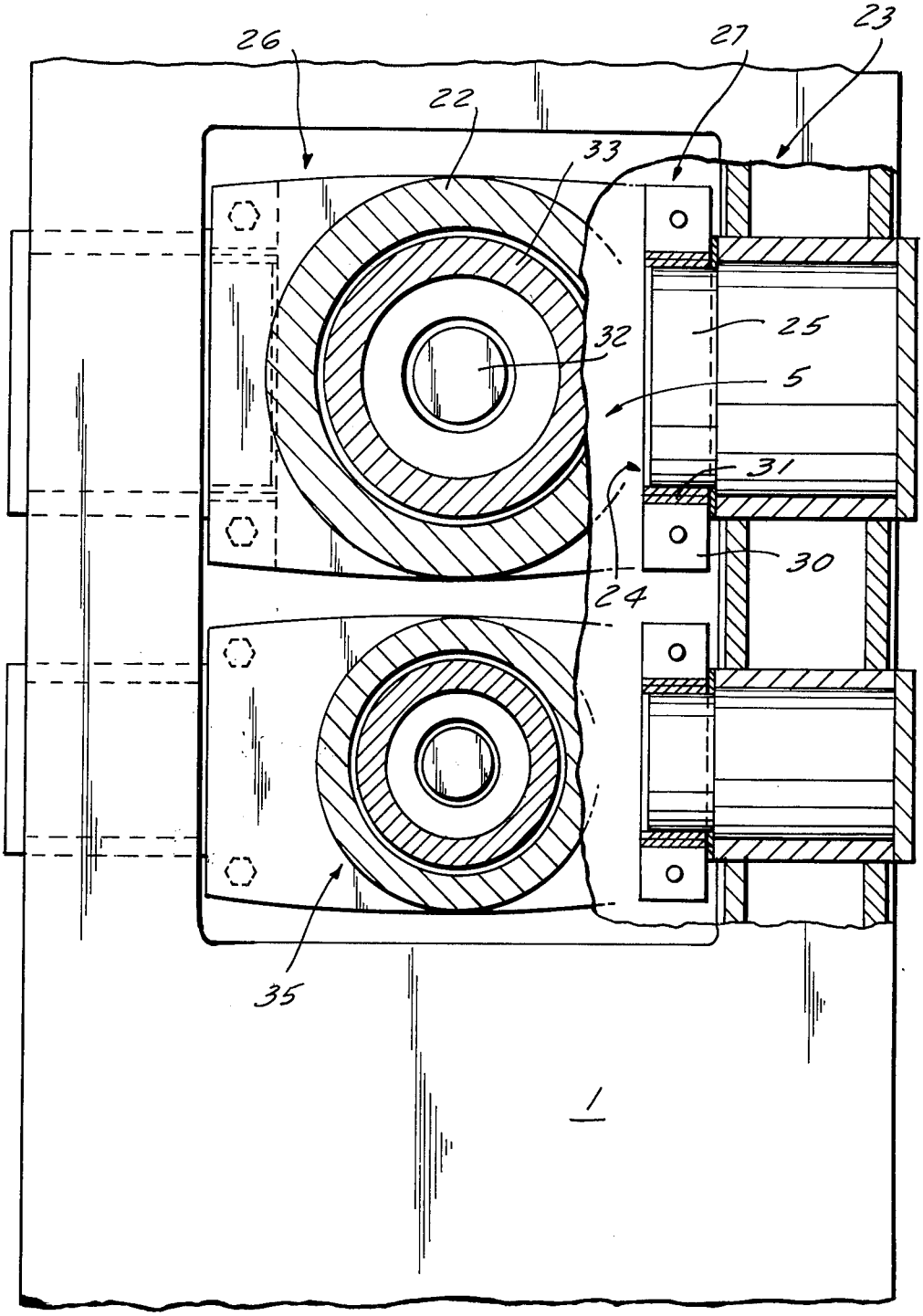
FIG. 3 is a view similar to that of FIG. 2 but illustrating the pivot assembly shown in FIG. 1B to a larger scale.

The plates 28 and 30 can be connected by transverse plates to a box-like housing structure which has not been illustrated except for the endwall 23*a*, this box-like structure connecting bracket 32*a* to plate 30 and forming an enclosure at least in part for the piston 32 as represented in dot-dash lines at 32*b* in FIG. 1.

The upper beam 3 is provided with a hold-down device 34. The hold-down device 34 is mounted, via the piston and cylinder column 35, on the lower beam 1 via a transverse bearing 6' similar to the lower bearing 6 previously described. The piston rod 35*a* of this cylinder is connected via a transverse bearing 37 to the bar 34*a* of the hold-down device. Between the upper beam 3 and the hold-down device 34 there can be provided a plug coupling 38.

In operation, after the hold-down device has been first lowered by the hydraulic cylinder 35 and the beam 3 synchronously and simultaneously lowered by connecting the two cylinders 35 and 5 in a common hydraulic network in the manner described, the hold-down device engages the workpiece. Thereupon, the beam 3 continues to lower to bring the ram 4 into play, the relative movement between the beam 3 and the hold-down device 34 being determined by the maximum penetration by the male member of the plug connection 38 into the female member thereof. It will be apparent that the system described permits ready operation of the hydraulic press with some canting of the upper beam 3 and of the hold-down device 34 without applying bending moments to the respective cylinders 35 and 5. Elongation of the beam 3 within the stand 20 in the direction of arrow B is also permitted.

I claim:

1. A hydraulic press comprising:

a lower beam formed with a press bed;

a vertically displaceable upper beam disposed above said lower beam and formed with a ram;

a plurality of columns connecting said lower beam and said upper beam and formed as respective piston-and-cylinger arrangements for displacing said upper beam relative to said lower beam;

and a transverse bearing connecting the upper end of each of said columns with an end of said upper beam and a lower end of each of said columns with an end of said lower beam whereby said upper beam can cant without applying bending moments to said piston-and-cylinder arrangement.

2. The press defined in claim 1 wherein each of the transverse bearings of said upper beam comprises, at the respective end thereof, a pair of bearing halves receiving a horizontal bearing pin between them, said bearing pin being provided with a throughgoing bore, the respective piston-and-cylinder arrangement including a piston rod extending through said bore and fixed to the respective pin above and below the pin by respective nuts threaded onto said piston rod.

3. The press defined in claim 2 wherein each of the transverse bearings on said lower beam is formed with at least one pin having a horizontal axis and fixed to said lower beam, said piston-and-cylinder arrangement including a cylinder swingably mounted upon the pin of the respective lower transverse bearing.

4. The press defined in claim 3 wherein said upper and lower bearing halves each is formed as a plate provided with a circular segmental cutout receiving the pin of the respective upper bearing, said plates being bolted together to form a closed bearing shell receiving the latter pin.

5. The press defined in claim 3, further comprising respective side stands receiving the respective column and slidably guiding the respective end of said upper beam for elongational and contractile movement in the direction of the length of the respective end of said upper beam while permitting vertical movement of said upper beam, said side stand and said upper beam being formed with slidably engaging guide members on juxtaposed surfaces perpendicular to the axis of the upper bearing.

6. The press defined in claim 3, further comprising a hold-down device displaceable relative to said lower beam and respective columns each formed as a further piston-and-cylinder mechanism connecting said hold-down device to said lower beam, said device being pivotally connected to the respective column and the respective column being pivotally connected to said lower beam by respective transverse bearings having axes parallel to the first-mentioned transverse bearings.

7. The press defined in claim 6 further comprising a plug coupling between said hold-down device and said upper beam.

8. The press defined in claim 3 wherein each of said cylinders is formed at its lower end with a bifurcated head, said bifurcated head being provided with respective openings receiving respective bearing pins having a common horizontal axis.

9. The press defined in claim 8 wherein said bifurcated head is subdivided into two parts connected together by bolts and receiving said pins between them.

10. The press defined in claim 8, further comprising a retraction piston extending between the pins of the respective lower bearing, a retraction cylinder being displaceable on said retraction piston and forming the piston of said arrangement.

11. The press defined in claim 8, wherein at least the upper part of said bifurcated head is formed unitarily with said cylinder.

12. The press defined in claim 11, wherein said lower bearings are each formed with plates bolted to the arms of said bifurcated head to enclose the respective pin therewith.

* * * * *